US007461643B2

(12) United States Patent
Reichardt et al.

(10) Patent No.: US 7,461,643 B2
(45) Date of Patent: Dec. 9, 2008

(54) BREATHER ASSEMBLY FOR AN INTERNAL COMBUSTION ENGINE

(75) Inventors: Douglas D. Reichardt, West Bend, WI (US); Charles J. Lamb, Greendale, WI (US)

(73) Assignee: Harley-Davidson Motor Company Group, Inc., Milwaukee, WI (US)

( * ) Notice: Subject to any disclaimer, the term of this patent is extended or adjusted under 35 U.S.C. 154(b) by 76 days.

(21) Appl. No.: 11/539,338

(22) Filed: Oct. 6, 2006

(65) Prior Publication Data

US 2008/0083398 A1 Apr. 10, 2008

(51) Int. Cl.
*F02M 25/06* (2006.01)

(52) U.S. Cl. ..... 123/572

(58) Field of Classification Search ..... 123/572–574, 123/41.86

See application file for complete search history.

(56) References Cited

U.S. PATENT DOCUMENTS 5,233,967 A 8/1993 Peller
5,881,686 A * 3/1999 Schmidt ..... 123/41.86
5,937,816 A * 8/1999 Wincewicz et al. ..... 123/195 A
6,065,457 A * 5/2000 Hoffmann et al. ..... 123/572
6,263,847 B1 7/2001 Hoffmann et al.
6,345,613 B1 2/2002 Hoffmann et al.
6,672,294 B1 * 1/2004 Pirone ..... 123/572
7,246,610 B2 * 7/2007 Sjovall et al. ..... 123/572
2005/0178371 A1 8/2005 Sjovall et al.
2006/0000458 A1 1/2006 Dees et al.

OTHER PUBLICATIONS

Buell® American Motorcycles, 2004 Buell® Parts Catalog, Lightning® Models Official Factory Catalog—Part No. 99571-04Y, pp. 4-7.

* cited by examiner

*Primary Examiner*—M. McMahon
(74) *Attorney, Agent, or Firm*—Michael Best & Friedrich LLP

(57) ABSTRACT

A rocker box assembly for a motorcycle engine having a cylinder head. The rocker box assembly includes a base, a cover, and a breather assembly. The base is configured to be coupled to the cylinder head. The cover is coupled to the base and cooperates with the base to at least partially define a rocker chamber and to at least partially define a breather assembly housing within the rocker chamber. The breather assembly is positioned within the breather assembly housing and is operable to vent a pressure pulse from within the engine.

18 Claims, 8 Drawing Sheets

BREATHER ASSEMBLY FOR AN INTERNAL COMBUSTION ENGINE

BACKGROUND

The present invention relates to breather assemblies for internal combustion engines.

During operation of a piston-cylinder type internal combustion engine, reciprocal movement of the pistons in the cylinders creates pressure pulses within the various chambers of the engine. For example, during an intake or expansion stroke of the piston, pressure within the crankcase of the engine generally increases, whereas during a compression or exhaust stroke of the piston, pressure within the crankcase of the engine generally decreases. The pressure pulses in the crankcase can be communicated to other chambers within the engine, such as the rocker box area, via breather passages, oil flow passageways, and the like. To reduce internal engine losses, often referred to as "pumping losses," many internal combustion engines utilize a breather system that operates to dissipate the pressure pulses within the crankcase, the rocker box, and other chambers of the engine.

Movement of various internal engine components also creates an oil mist that is carried throughout the engine by the pressure pulses. It is often desirable to separate as much of the oil mist as possible from the gasses that may be expelled from the engine through the breather system. Many breather systems remove the oil mist from the air by routing the internal engine gasses through screens, meshes, and various serpentine paths before discharging the gasses to the atmosphere. To reduce emissions to the atmosphere, some breather systems route some or all of the gasses expelled from the breather system to the engine's air/fuel intake stream (e.g. to the airbox or to the intake manifold).

SUMMARY

In one embodiment of the invention, a rocker box assembly includes a base, a cover, and a breather assembly. The base is configured to be coupled to the cylinder head. The cover is coupled to the base and cooperates with the base to at least partially define a rocker chamber and to at least partially define a breather assembly housing within the rocker chamber. The breather assembly is positioned within the breather assembly housing and is operable to vent a pressure pulse from within the engine.

In another embodiment, the cover of the rocker box assembly includes an aperture The breather assembly is positioned within the rocker chamber and is operable to vent a pressure pulse from within the engine through the breather assembly and out the aperture of the cover.

In yet another embodiment, a breather assembly includes a body having a baffle portion defining a serpentine path and a check valve member coupled to the body. The body is integrally formed as a single piece and is configured to be disposed within the rocker chamber.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
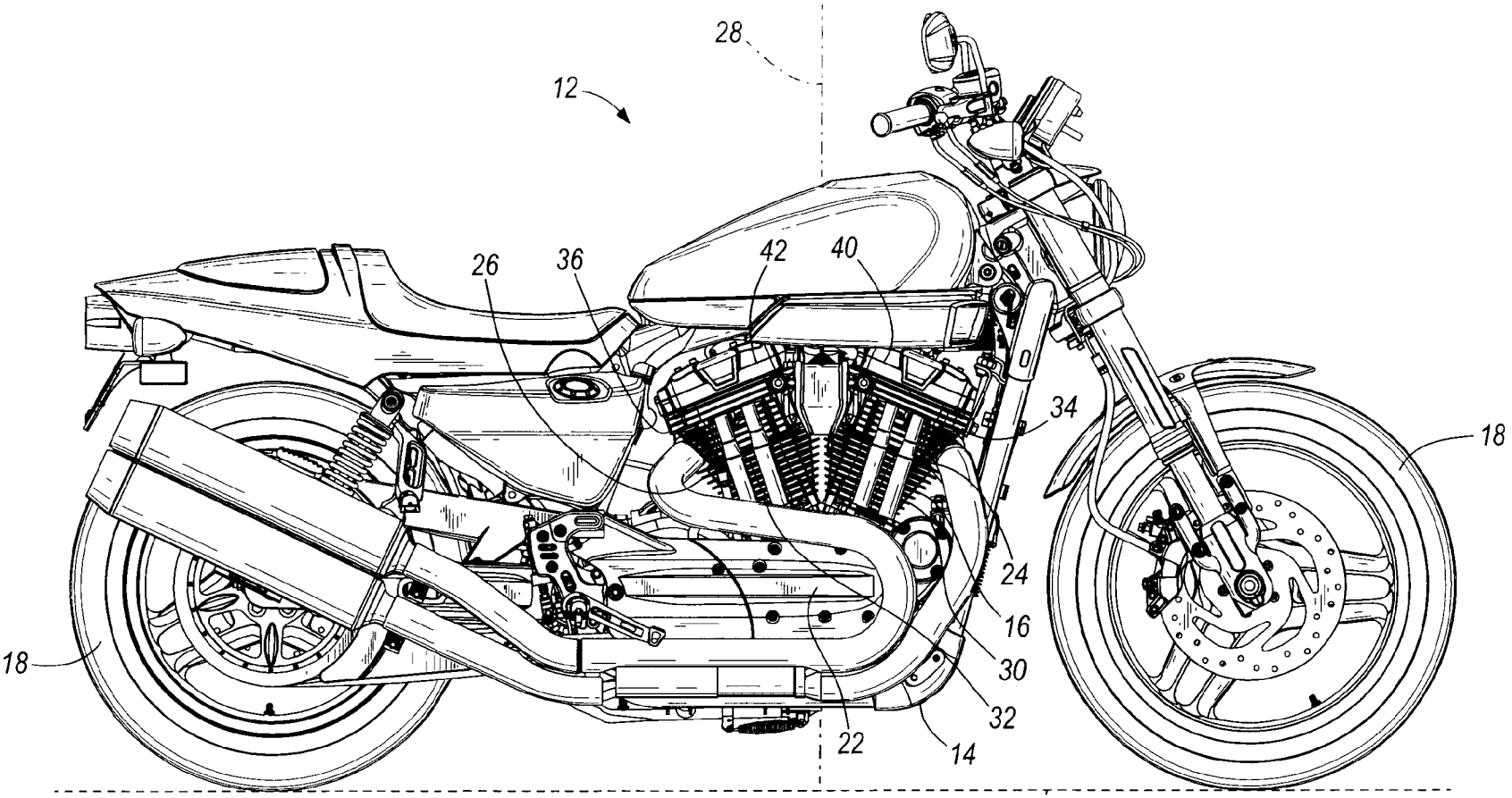
FIG. 1 is a side view of a motorcycle that includes rocker box assemblies embodying the present invention.

FIG. 1 illustrates a motorcycle 12 that includes a frame 14 and an engine assembly 16 coupled to the frame 14. The motorcycle 12 further includes wheels 18 that support the motorcycle 12 on a riding surface 20. The engine assembly 16 includes a crankcase 22, a first cylinder assembly 24 that extends upwardly and forwardly from the crankcase 22, and a second cylinder assembly 26 that extends upwardly and rearwardly from the crankcase 22. The first and second cylinder assemblies 24 and 26 are arranged with respect to one another define a "V-twin" engine configuration. In the illustrated "V-twin" engine configuration the cylinder assemblies 24 and 26 are orientated at a 45 degree angle with respect to each at a 22.5 degree angle with respect to an axis 28 that is normal to the riding surface 20.

Each of the cylinder assemblies 24 and 26 includes an engine cylinder 30, 32 and a cylinder head 34, 36 coupled to an end of a respective cylinder 30, 32. Each cylinder assembly 24, 26, also includes a rocker box assembly 40, 42, respectively, coupled to a respective cylinder head 34, 36. In the illustrated construction, both of the rocker box assemblies 40 and 42 are substantially the same. Therefore, only the rocker box assembly 40 and its operation will be discussed in detail below.

Figure 2:
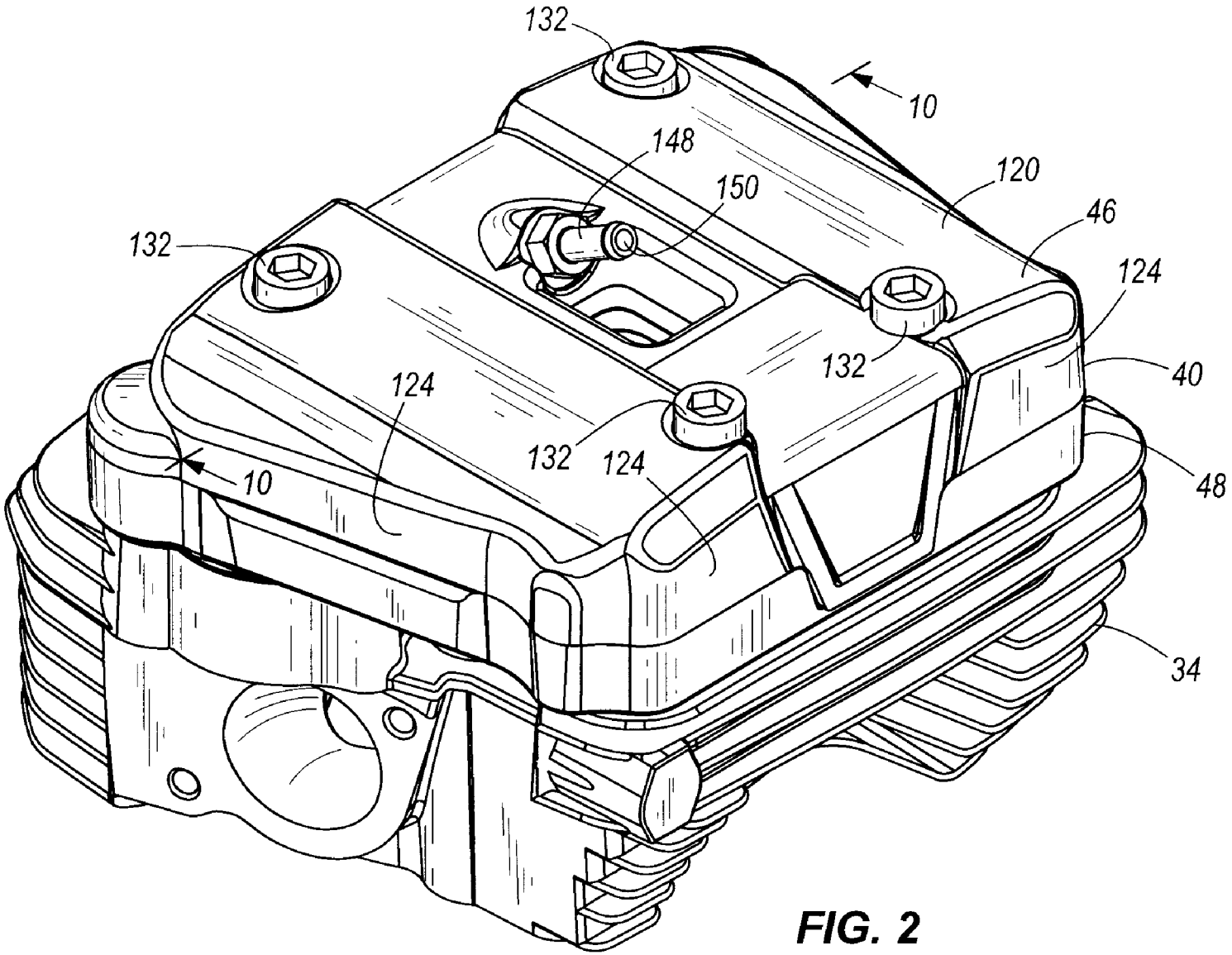
FIG. 2 is a perspective view of a cylinder head and a rocker box assembly of the motorcycle of FIG. 1.
Figure 3:
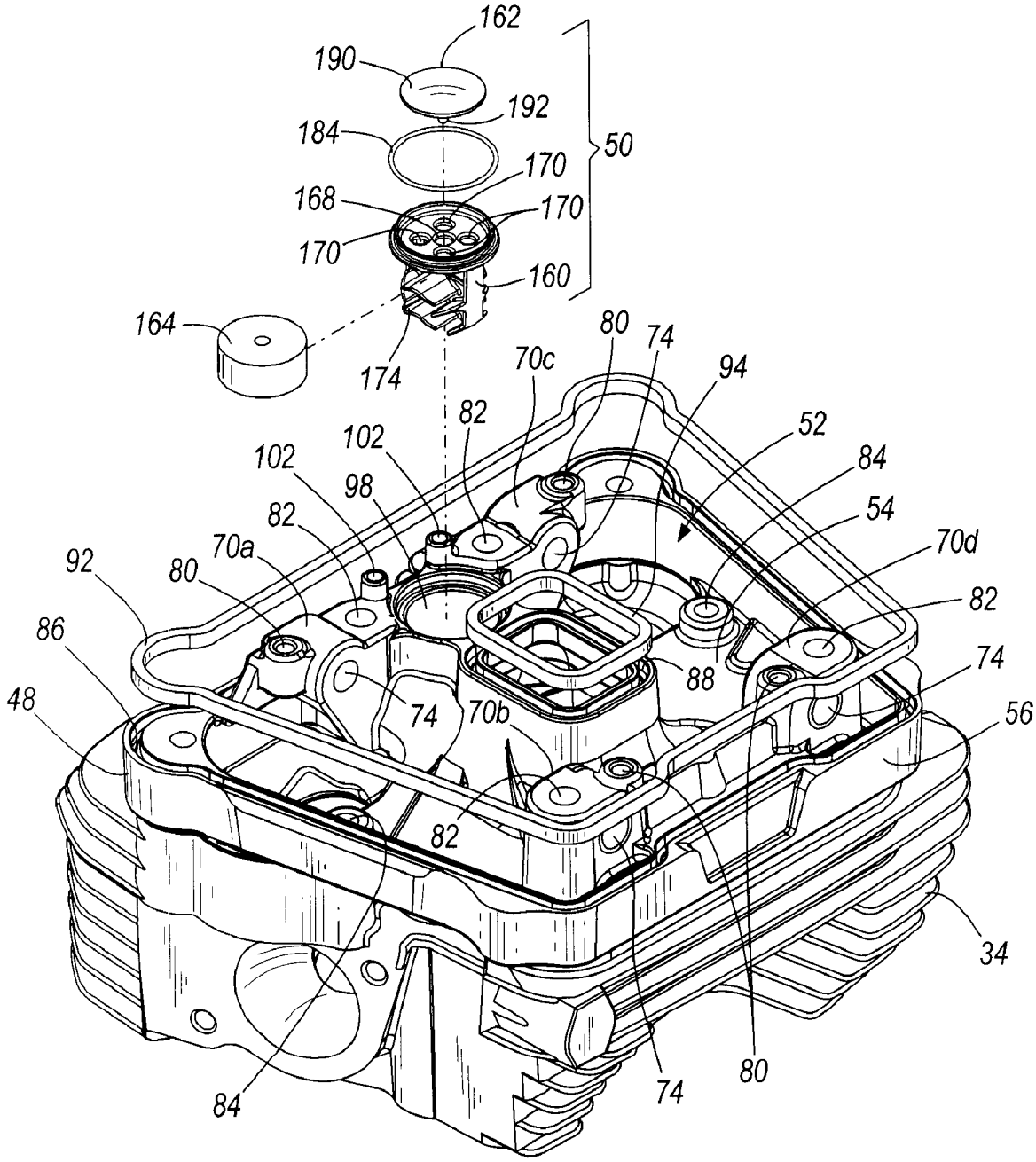
FIG. 3 is a partially exploded view of the rocker box assembly of FIG. 2 with the cover of the rocker box assembly removed.
Figure 5:
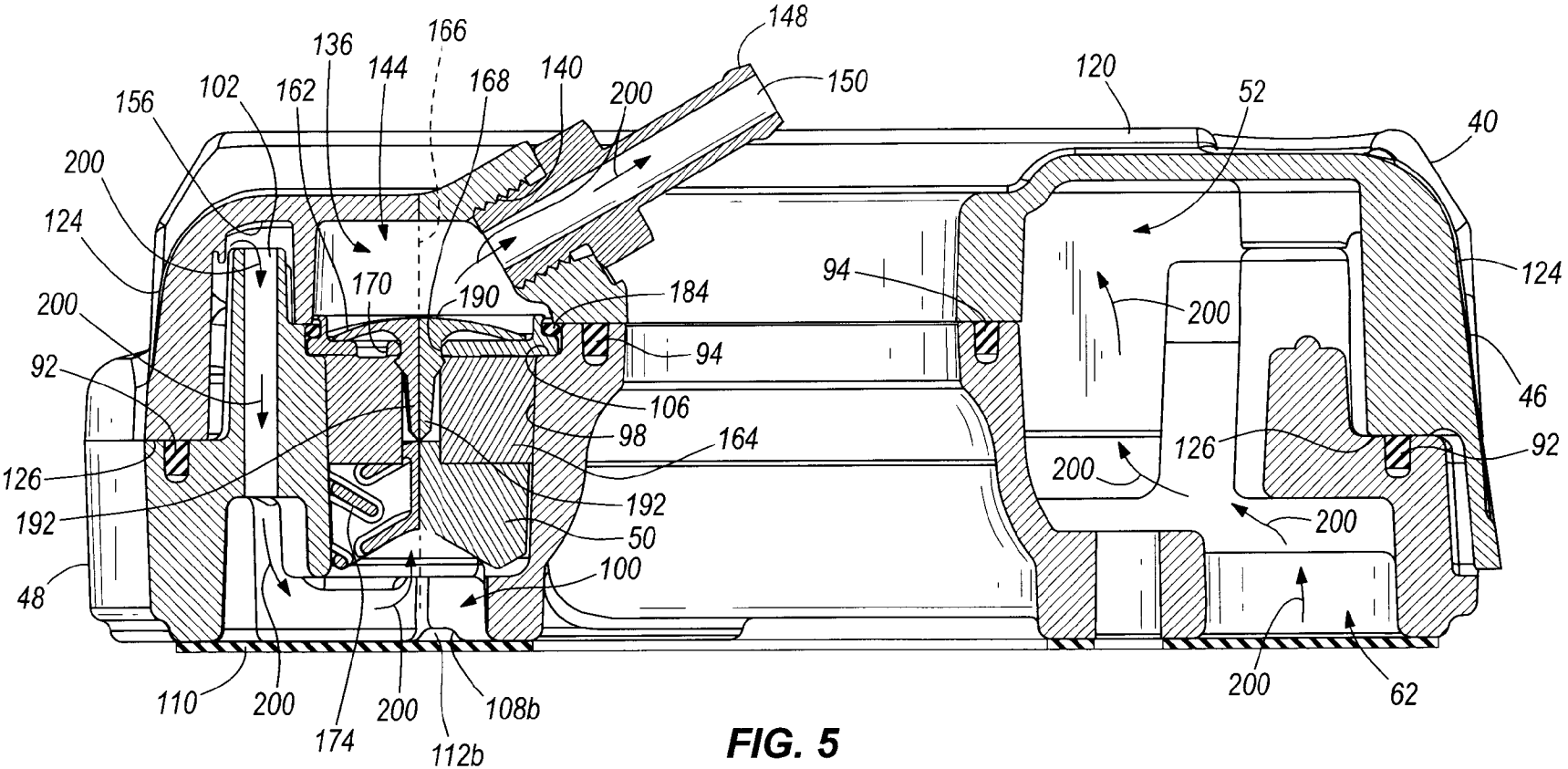
FIG. 5 is a cross-section view of the rocker box assembly taken along line 5-5 of FIG. 4, but with the cover of the rocker box assembly coupled to the base.

Referring to FIGS. 2 and 3, the rocker box assembly 40 includes a cover 46, a base 48, and a breather assembly 50. The cover 46 is coupled to the base 48 such that the cover 46 and the base 48 define a rocker chamber 52 (FIG. 5).

Figure 4:
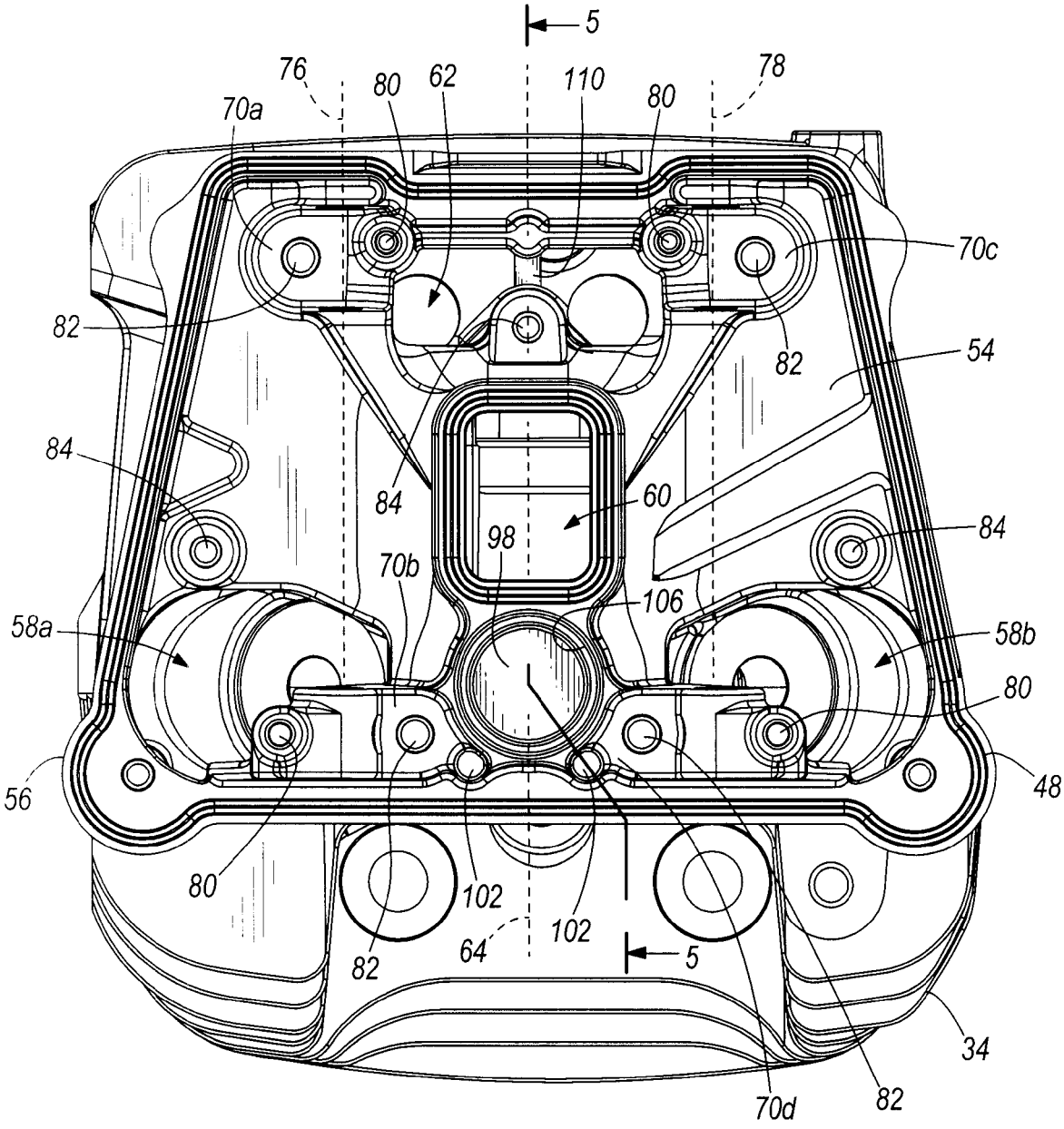
FIG. 4 is a top view of the cylinder head and rocker box assembly of FIG. 2 with the cover of the rocker box assembly removed.

As illustrated in FIGS. 3 and 4, the base 48 includes a lower wall 54 and a perimeter wall 56 that extends upwardly from the lower wall 54. The lower wall 54 defines a pair of valve openings 58*a*, 58*b* through which engine valves (not shown) extend. The lower wall 54 of the base 50 also defines a central opening 60 and a pushrod opening 62 through which pushrods extend. A central plane 64 of the base 48 is defined as a plane that extends through the center of the central opening 60, generally through the center of the pushrod opening 62, between the valve openings 58*a*, 58*b*, and generally normal to the lower wall 54.

The base 48 further includes four rocker supports 70*a*-70*d* that extend upwardly from the lower wall 54. Each rocker support 70*a*-70*d* defines a rocker support bore 74. The rocker support bores 74 of one pair of rocker supports 70*a*, 70*b* are substantially aligned and define a first axis 76 on one side of the central plane 64. Rocker support bores 74 of the other pair of rocker supports 70*c*, 70*d* are also substantially aligned and define a second axis 78 on an opposite side of the central plane 64. The rocker support bores 74 of the rocker supports 70*a*, 70*b* support a first rocker shaft (not illustrated) that is generally co-axial with the first axis 76, and the rocker support bores 74 of the rocker supports 70*c*, 70*d* support a second rocker shaft (not illustrated) that is generally co-axial with the second axis 78. Rockers (not illustrated) pivot on the rocker shafts during engine operation.

Each of the rocker supports 70*a*-70*d* also defines a cover mounting aperture 80 and a base mounting aperture 82. The base mounting apertures 82 are substantially normal to and extend through the lower wall 54 of the base 48. The base mounting apertures 82 are aligned with corresponding apertures in the cylinder head 34 and a fastener is inserted into each of the mounting apertures 82 to couple the base 48 to the cylinder head 34. The base 48 further defines additional mounting apertures 84 that extend through the base 48 and are designed to receive fasteners to couple the base 48 to the cylinder head 34.

The perimeter wall 56 of the base 48 defines an outer seal recess 86 that extends around the perimeter of the base 48 in the top of the perimeter wall 56. The base 48 further defines an inner seal recess 88 that surrounds the central opening 60. The recesses 86, 88 receive seals 92, 94, respectively, to substantially seal an interface between the base 48 and the cover 46.

Referring to FIGS. 3, 4, and 5, the base 48 further defines a breather assembly receiving aperture 98, a breather assembly inlet chamber 100, and breather assembly inlet passages 102. The breather assembly receiving aperture 98 includes a ledge 106 that supports the breather assembly 50 within the receiving aperture 98. As best seen in FIG. 4, the central plane 64 of the base 48 extends generally through the center of the breather assembly receiving aperture 98. While the illustrated breather assembly receiving aperture 98 is generally cylindrical, in other constructions the breather assembly receiving aperture can take other suitable shapes.

The illustrated breather assembly inlet passages 102 are generally cylindrical apertures that are substantially normal to the lower wall 54 of the base 48. The breather assembly inlet passages 102 provide fluid communication between the rocker chamber 52 and the breather assembly inlet chamber 100. While the illustrated base 48 includes two breather assembly inlet passages 102, one on each side of the central plane 64, in other constructions the base can include any suitable number of breather assembly inlet passages at any suitable location.

Figure 6:
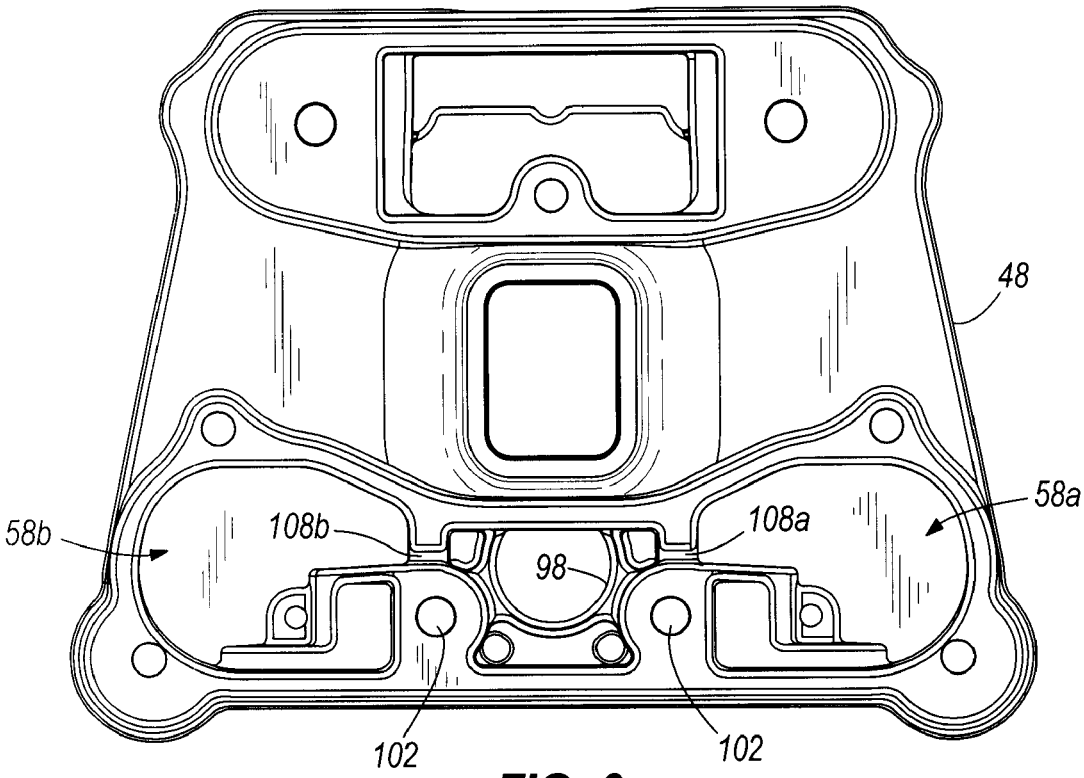
FIG. 6 is a bottom view of the base of the rocker box assembly of FIG. 2.
Figure 7:
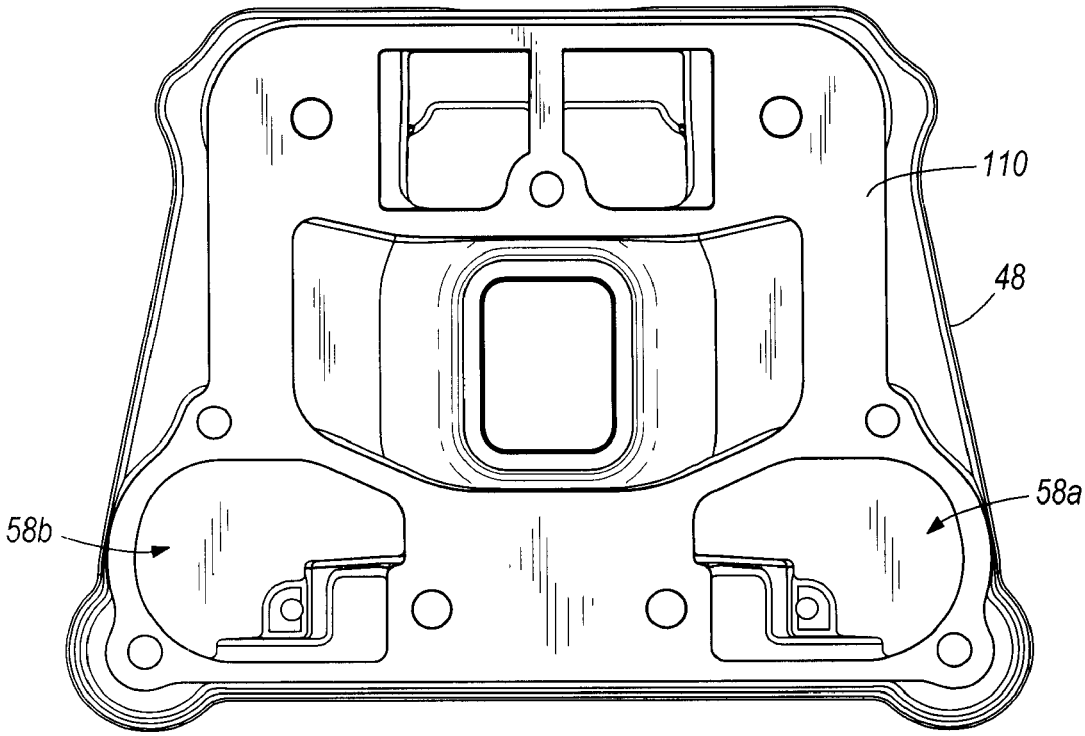
FIG. 7 is a bottom view of the base of the rocker box assembly of FIG. 2 including a gasket.

As best seen in FIGS. 5 and 6, grooves 108*a* and 108*b* in the base 48 and a gasket 110 located between the base 48 and the cylinder head 34 (FIG. 3) cooperate to define drainage passageways 112*a*, 112*b*. The drainage passageways 112*a*, 112*b* provide fluid communication between the breather assembly inlet chamber 100 and the valve openings 58*a*, 58*b* (FIG. 4), respectively. The gasket 110 inhibits fluid communication between the valve openings 58*a*, 58*b* and the breather assembly inlet chamber 100 except through the drainage passageways 112*a*, 112*b*.

Figure 8:
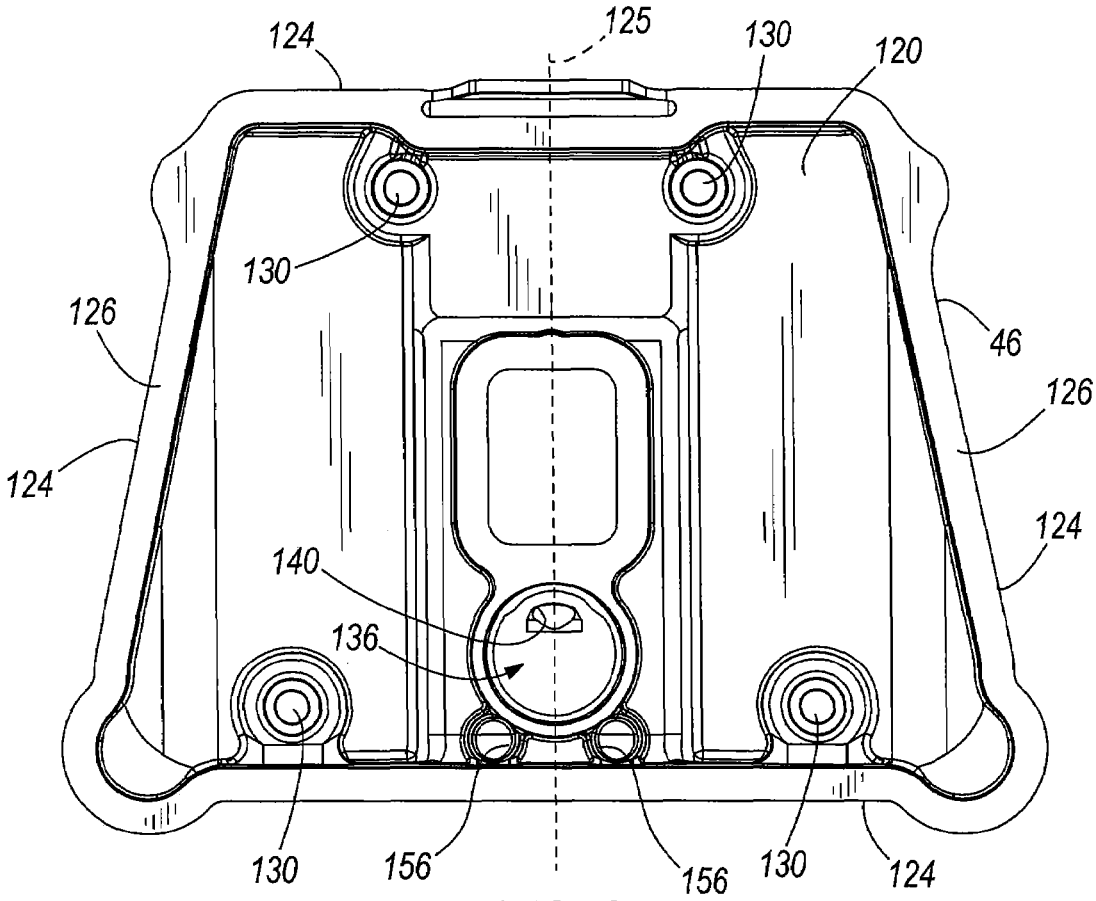
FIG. 8 is a bottom view of the cover of the rocker box assembly of FIG. 2.

Referring to FIGS. 2, 5, and 8, the cover 46 includes a top wall 120 and a perimeter wall or side walls 124 that extend from the top wall 120. The cover 46 defines a central plane 125 that is centrally located between two of the side walls 124 and normal to the top wall 120. The central plane 125 of the cover 46 is generally co-planar with the central plane 64 of the base 48 when the base 48 and cover 46 are assembled.

Referring to FIGS. 5 and 8, the side walls 124 of the cover 46 include substantially planar ends 126 that directly engage to the outer seal member 92 and the perimeter wall 56 of the base 48 to substantially seal the interface between the cover 46 and the base 48 around the perimeter of the rocker chamber 52.

Referring to FIGS. 2 and 8, the cover 46 further includes cover apertures 130 that can be aligned with the cover mounting apertures 80 of the base 48 (FIG. 4) such that the apertures 80 and 130 receive fasteners 132 to couple the cover 46 to the base 48.

Referring to FIGS. 5 and 8, the cover 46 defines a breather assembly outlet chamber 136 and a breather assembly outlet aperture 140 that extends through the top wall 120 of the cover 46, in fluid communication with the breather assembly outlet chamber 136. The breather assembly outlet aperture 140 and the breather assembly outlet chamber 136 are centrally located on the central plane 125 of the cover 46.

As best seen in FIG. 5, together the breather assembly outlet chamber 136, defined by the cover 46, and the breather assembly receiving aperture 98, defined by the base 48, define a breather assembly housing 144. The breather assembly housing 144 is located within the rocker chamber 52 and houses the breather assembly 50.

The breather assembly outlet chamber 136 and the breather assembly receiving aperture 98, which together define the breather assembly housing 144, are integrally formed with the cover 46 and the base 48, respectively, as a single piece. In one construction, the base 48 is cast and the breather assembly receiving aperture 98 is integrally cast with the base 48 such that the base 48 and the breather assembly receiving aperture 98 are a single piece. Similarly, the cover 46 is also cast and the breather assembly outlet chamber 136 is integrally cast with the cover 46 such that the cover 46 and the breather assembly outlet chamber 136 are a single piece. In other constructions, the breather assembly receiving aperture 98 and the breather assembly outlet chamber 136 can be integrally formed with the base 48 and cover 46, respectively, using any suitable method, such as molding, machining, and the like.

Referring to FIGS. 2 and 5, the breather assembly outlet aperture 140 receives a coupling 148 that defines a passageway 150. The coupling 148 can be used to couple a conduit such as tubing, piping and the like, to the rocker box assembly 40. The conduit can provide fluid communication between the rocker box assembly 40 and another portion of the motorcycle 12, such as the throttle body, air intake, etc.

Referring to FIGS. 5 and 8, the cover 46 further includes breather assembly inlet passage covers 156 that extend from the inside surface of the top wall 120. The illustrated cover 46 includes two inlet passage covers 156 that correspond with the two breather assembly inlet passages 102 of the base 48. As best seen in FIG. 5, the inlet passage covers 156 receive the inlet passages 102. The inner dimension of the inlet passage covers 156 are slightly larger than the outer dimension of the inlet passages 102. Therefore, a serpentine flow path is created by the inlet passage covers 156, the purpose of which will be discussed below.

Figure 9:
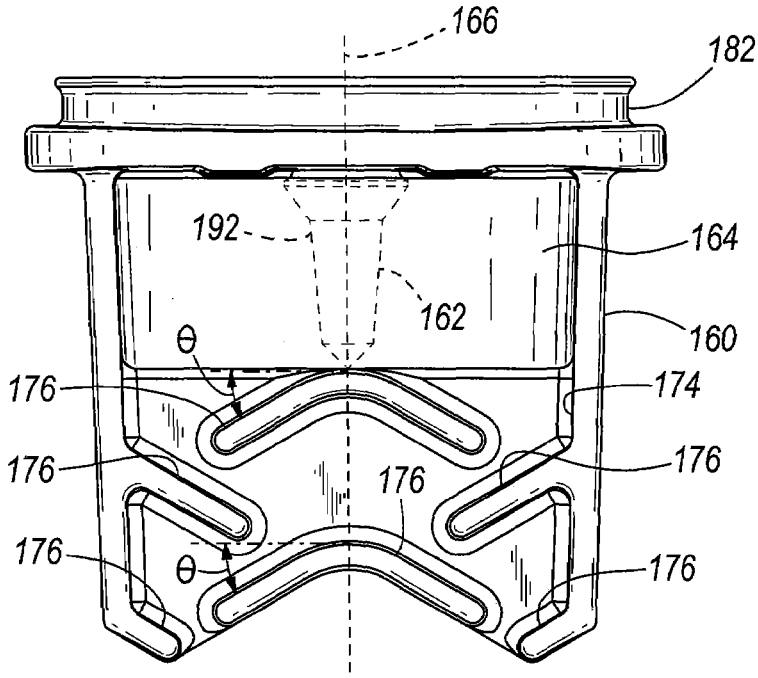
FIG. 9 is a side view of a breather assembly of the rocker box assembly of FIG. 2.

Referring to FIGS. 3 and 9, the illustrated breather assembly 50 includes a body portion 160, a check valve member 162, and filter media 164. The body portion 160 defines a longitudinal axis 166 and includes a central aperture 168 through which the longitudinal axis 166 extends and a plurality of vent apertures 170 that surround the central aperture 168. The body portion 160 includes a baffle portion 174 having a plurality of fins 176. The illustrated fins 176 are orientated at an angle θ with respect to the longitudinal axis 166. In the illustrated construction, the angle θ is approximately 30 degrees. In other constructions, the angle θ can range from about 25 degrees to about 35 degrees, and in yet other constructions, the angle θ is greater than about 22.5 degrees.

The body portion 160 of the breather assembly 50 further includes a seal receiving groove 182 that receives the seal 184, which is an O-ring seal in the illustrated construction. As best seen in FIG. 5, the seal 184 substantially seals the breather assembly housing 144 at the interface of the cover 46 and the base 48.

In the illustrated construction, the body portion 160 of the breather assembly 50 is integrally formed as a single piece, such as by casting, molding, machining and the like.

Referring to FIGS. 3 and 5, the check valve member 162 of the breather assembly 50 includes a resilient valve member 190 and a protrusion 192 that extends from the resilient valve member 190. When the check valve member 162 is coupled to the body portion 160, the resilient valve member 190 covers the vent apertures 170 and the protrusion 192 extends through the central aperture 168 of the body portion 160 to couple the check valve member 162 to the body portion 160.

The filter media 164 can be any suitable filter media. In the illustrated construction, the filter media is open-cell foam and is located between the baffle portion 174 and the check valve member 162.

Referring to FIGS. 3 and 5, to assemble the breather assembly 50 with the base 48 and the cover 46, the breather assembly 50 is placed or set within the breather assembly receiving aperture 98 of the base 48. The breather assembly 50 is supported within the breather assembly receiving aperture 98 by the ledge 106. Because the ledge 106 defines a generally circular aperture and the portion of the breather assembly 50 supported by the ledge 106 is also generally circular, the breather assembly 50 can be placed within the breather assembly receiving aperture 98 at any rotational position about the longitudinal axis 166 of the breather assembly 50.

With the cover 46 of the rocker box assembly 40 removed from the base 48, the breather assembly 50 is free to move with respect to the base 48. Therefore, the breather assembly 50 can be removed from the breather assembly receiving aperture 98 by grasping the breather assembly 50 and lifting it from the receiving aperture 98. In the illustrated construction, the breather assembly 50 is not fixed with respect to the base 48 until the cover 46 is coupled to the base 48 and thus a portion of the breather assembly 50 is directly between the cover 46 and the base 48 to substantially prevent the breather assembly 50 from moving with respect to the cover 46 and the base 48. Therefore, the breather assembly 50 is not directly fastened to the base 48 and the breather assembly 50 is freely coupled to the base 48, and the breather assembly 50 can easily be removed and installed when the cover 46 has been removed from the base 48.

Referring to FIGS. 1, 4, and 5, during operation of the engine 16, pressure pulses are created within the engine 16 by moving components, such as pistons. Also, air/oil mist, vapor, mixture, etc. is circulated through the engine 16 by the pressure pluses and the air/oil mist enters the rocker box chamber 52 through passages such the pushrod opening 62, which is in fluid communication with the cylinder head 34. The air/oil mist enters the rocker box chamber 52 and migrates across the rocker box 40 toward the breather assembly inlet passages 102. Because the illustrated rocker box 40 includes a breather assembly inlet passage 102 on each side of the central plane 64, the air/oil mist is drawn from both sides of the rocker chamber 52 and only a single breather assembly 50 is utilized in the illustrated construction. The flow of the air/oil mist is generally represented by the arrows 200 in FIG. 5.

Before entering the breather assembly inlet passages 102, the air/oil mist travels through the serpentine flow path created by the breather assembly inlet passage covers 156. The serpentine flow path created by the inlet passage covers 156 causes at least some of the oil particles in the air/oil mist to accumulate on the inlet passage covers 156. The oil that accumulates on the inlet passage covers 156 eventually drips or flows onto the lower wall 54 of the base 48.

Referring to FIGS. 5 and 9, after traveling through the serpentine flow path created by the inlet passage covers 156, the air/oil mist enters the breather assembly inlet passages 102 and flows into the breather assembly inlet chamber 100. As indicated by the arrows 200, in the breather assembly inlet chamber 100, the air/oil mist turns upward and travels through the baffle portion 174 of the breather assembly 50. As the air/oil mist travels across the fins 176 of the baffle portion 174 at least some of the oil in the air/oil mist collects on the fins 176 and eventually drips or flows down onto the gasket 110.

Figure 10:
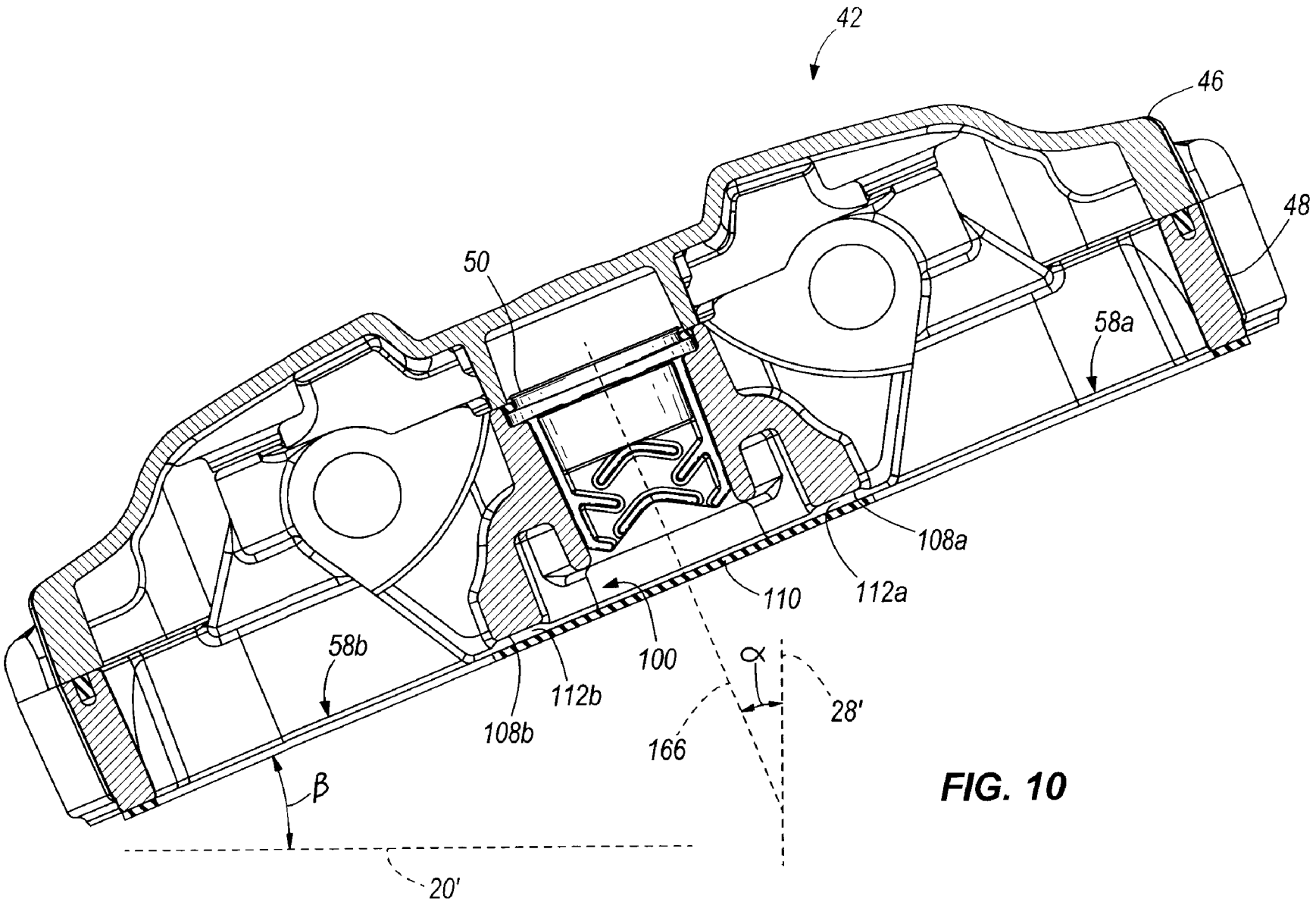
FIG. 10 is a cross-section view of the rocker box assembly taken along line 10-10 of FIG. 2.

Referring to FIGS. 1 and 10, because the illustrated engine 16 is a "V-twin" engine, the rocker boxes 40 and 42 are at a 22.5 degree angle, labeled β, with respect to the riding surface represented by the line 20' in FIG. 10. Therefore, the longitudinal axis 166 of the breather assembly 50 is at a 22.5 degree angle, labeled α, with respect a plane 28' that is parallel to the plane 28. Thus, in the illustrated construction, the fins 176, which are at the fin angle θ of 30 degrees with respect to the longitudinal axis 166 are at an angle of at least 7.5 degrees with respect to the riding surface 20, 20' (30 degrees minus 22.5 degrees).

In the illustrated construction, because the fin angle θ is greater than 22.5 degrees, the fins 176 are downwardly tapered with respect to the riding surface 20 regardless of the orientation of the breather assembly 50 within with breather assembly receiving aperture 98 and the oil that collects on the fins 176 flows down along the fins 176 due to gravity and eventually drips or flows onto the gasket 110. Therefore, oil is substantially prevented from collecting or pooling on the fins 176.

With the gasket 110 at the angle β (22.5 degrees in the illustrated construction) with respect to the riding surface 20, 20', gravity causes the oil to flow on the gasket 110 and through the drainage passage **112*b* and through the valve opening 58*b* back to the cylinder head. The oil can flow through either the drainage passages 112*a*, 112*b* depending on which drainage passage 112*a*, 112*b* is at a lower elevation with respect to the riding surface 20, 20**,'.

The illustrated base 48 includes the two grooves **108*a* and 108*b* that define the two drainage passages 112*a*, 112*b* so that the same base 48, and therefore the same rocker box assembly, can be used with either the front cylinder head 34 or the rear cylinder head 36. Therefore, depending on whether the base 48 is used with the front or rear cylinder head 34, 36, one of the drainage passages 112***a*, 112*b* will be at the lowest elevation of the breather assembly inlet chamber 100 with respect to the riding surface 20, 20'.

Referring to FIG. 5, after the air/oil mist travels through the baffle portion 174 of the breather assembly 50, the air/oil mist travels through the filter media 164. The filter media 164 collects additional oil. Oil collected by the filter media 164 eventually travels down along the fins 176 as discussed above.

Referring to FIGS. 3 and 5, as a result of pistons and other moving components within the engine, pressure pulses are created within the rocker chamber 52. When the pressure of the air increases past a predetermined point, the air deflects the resilient valve member 190 and the air/oil mist, after traveling through the filter media 164, travels though the vent apertures 170 and into the breather assembly outlet chamber 136. The mist then exits the breather assembly outlet chamber 136 through the breather assembly outlet aperture 140 in the cover 46. The mist then passes through the passage 150 of the coupling 148 and through a conduit (not illustrated) to another portion of the motorcycle 12 such as the air cleaner or throttle body where the mist is introduced into the air/fuel intake flow path of the engine 16.

The pressure pulses can also cause the pressure in the rocker chamber 52 to be less than the pressure in the breather assembly outlet chamber 136. In such a condition, the resilient valve member 190 of the check valve member 162 seals tightly against the body portion 160 of the breather assembly 50, sealing the vent apertures 170 to substantially prevent flow from the breather assembly outlet chamber 136 into the breather assembly inlet chamber 100.

Various features and advantages of the invention are set forth in the following claims.

What is claimed is:

1. A rocker box assembly for a motorcycle engine having a cylinder head, the rocker box assembly comprising:

a base configured to be coupled to the cylinder head, the base including a receiving aperture;

a rocker chamber cover coupled to the base and cooperating with the base to at least partially define a rocker chamber, the cover defining a chamber that cooperates with the receiving aperture of the base to at least partially define a breather assembly housing within the rocker chamber, the cover further including an outlet aperture; and a breather assembly positioned within the breather assembly housing and operable to vent a pressure pulse from within the engine out of the rocker chamber, the breather assembly being operable to vent the pressure pulse in an upward direction and out of the breather assembly through the outlet aperture of the cover.

2. The rocker box assembly of claim 1, wherein the breather assembly housing includes a first portion defined by the base and a second portion defined by the cover, and wherein the first and second portions of the breather assembly housing are integrally formed as a single piece with the base and the cover, respectively.

3. The rocker box assembly of claim 2, wherein the first portion of the breather assembly housing includes the receiving aperture formed in the base, and wherein the receiving aperture formed in the base receives a portion the breather assembly.

4. The rocker box assembly of claim 3, wherein the breather assembly includes a body portion, and wherein the first portion of the breather assembly housing includes a ledge that supports the body portion of the breather assembly within the breather assembly housing.

5. The rocker box assembly of claim 1, wherein the base includes a breather assembly inlet passage that provides fluid communication between the rocker chamber and the breather assembly housing, and wherein the cover includes an inlet passage cover that at least partially surrounds the breather assembly inlet passage to create a serpentine path in a flow path between the rocker chamber and the breather assembly housing.

6. The rocker box assembly of claim 1, wherein the breather assembly includes a seal configured to substantially seal an interface between the base and the cover.

7. The rocker box assembly of claim 1, wherein the base defines a breather assembly inlet chamber, wherein the breather assembly includes a check valve that allows flow from the breather assembly inlet chamber toward the outlet aperture while substantially preventing flow from the outlet aperture toward the breather assembly inlet chamber.

8. The rocker box assembly of claim 1, wherein the breather assembly defines a longitudinal axis, and wherein the breather assembly is insertable into and operable within the breather assembly housing at any rotational position about the longitudinal axis.

9. The rocker box assembly of claim 1, wherein the breather assembly is freely coupled to the base.

10. The rocker box assembly of claim 9, wherein the breather assembly is not directly fastened to the base.

11. A breather assembly for a motorcycle engine having a cylinder head, a base coupled to the cylinder head, a cover coupled to the base and cooperating with the base to at least partially define a rocker chamber, the breather assembly comprising:

a body including a baffle portion defining a serpentine path, the body integrally formed as a single piece and configured to be disposed within the rocker chamber; and a check valve member coupled to the body, wherein body of the breather assembly defines a longitudinal axis extending generally centrally through the breather assembly, and wherein the baffle portion of body includes a plurality of fins orientated at an angle with respect to the longitudinal axis, and wherein the angle is greater than about 22.5 degrees.

12. The breather assembly of claim 11, wherein the breather assembly further includes a filter media between the check valve member and the serpentine path.

13. The breather assembly of claim 11, wherein the body of the breather assembly includes an aperture and the check valve member includes a protrusion that extends through the aperture to couple the check valve member to the body.

14. The breather assembly of claim 11, wherein the angle is from about 25 degrees to about 35 degrees.

15. The breather assembly of claim 11, further comprising a sealing member adjacent to the body to provide a seal between the cover and the base.

16. The breather assembly of claim 11, wherein the breather assembly is generally cylindrical.

17. The rocker box assembly of claim 1, wherein the breather assembly is fixed relative to the base by the cover.

18. The rocker box assembly of claim 5, wherein the breather assembly inlet passage directs the pressure pulse in a first direction that is substantially towards the cylinder head, and wherein the pressure pulse flows through the breather assembly in a second direction that is substantially away from the cylinder head.

* * * * *